United States Patent [19]

Tschentscher

[11] 3,960,336

[45] June 1, 1976

[54] APPARATUS FOR FORMING A WASTE WINDING ADJACENT A RESERVE WINDING WHEN WINDING A THREAD ONTO A SPOOL

[75] Inventor: Alfred Tschentscher, Cologne, Germany

[73] Assignee: FMN Schuster & Co., Hurth-Efferen, Germany

[22] Filed: Apr. 22, 1975

[21] Appl. No.: 570,312

[30] Foreign Application Priority Data

Apr. 27, 1974 Germany ..... 2420564

[52] U.S. Cl. ..... 242/18 PW

[51] Int. Cl.[2] ..... B65H 54/02; D02G 1/16

[58] Field of Search ..... 242/18 PW

[56] References Cited

UNITED STATES PATENTS

| | | | |
|---|---|---|---|
| 2,221,999 | 11/1940 | Reiners et al. | 242/18 PW |
| 3,237,876 | 3/1966 | Franzen | 242/18 PW |
| 3,408,011 | 10/1968 | Lenk et al. | 242/18 PW |

*Primary Examiner*—Robert I. Smith
*Attorney, Agent, or Firm*—Neil F. Markva

[57] ABSTRACT

An apparatus forms a dead, short or waste winding adjacent a reserve winding when winding a thread onto a spool or the like. A delivery mechanism provides a supply of thread to a spool core at an end location axially displaced from the winding area of the spool. A winding forming means is located at the end location of the spool core. The winding forming means includes a rotatably mounted worm having a particular type of circumferential groove configuration disposed therealong. A predetermined number of narrow circumferential grooves having a relatively small pitch extend from the inlet side of the worm toward the outlet side thereof. Immediately thereafter, at least one further circumferential groove having a larger pitch than the grooves disposed toward the inlet side of the worm extends from the end of the small pitch circumferential grooves to the outlet side of the worm. The narrow circumferential grooves having a smaller pitch are effective to cause the formation of a waste winding before the production of the reserve winding.

6 Claims, 7 Drawing Figures

APPARATUS FOR FORMING A WASTE WINDING ADJACENT A RESERVE WINDING WHEN WINDING A THREAD ONTO A SPOOL

BACKGROUND OF THE INVENTION

The invention relates to an apparatus for forming a dead, short or waste winding before the production of a reserve winding when winding a thread onto a spool or the like. The thread is fed from a delivery mechanism via a changeover or traversing device to the spool. The start or end of the thread is inserted into an entrainment device such as a notch or groove formed in the spool.

It is known to expose the thread to a short duration deviation by forming a loop therein during the time while the thread is in an untensioned condition. This occurs when the end of the thread is initially secured to the end location of the spool. Specific reference is made to my copending application, Ser. No. 413,738 filed Nov. 7, 1973. This known assembly is effective to keep the thread under a constant tension during the insertion thereof onto the spool. The formation of this loop which may be by a stream of air from a blowing device maintains the appropriate amount of tension during the time that the thread tangentially encounters a means for forming a reserve winding on the spool until the thread has been brought up to the thread guide of the traversing device. At that time, the thread catches on the thread guide of the self-threading traversing device. Consequently, the thread is automatically transferred to the traversing device upon being fixed to the spool via the formation of a reserve winding.

The reserve winding forming mechanism includes a rotatably mounted worm which is tangentially engaged by the thread. The thread is transported by the worm and automatically guided over the width of the reserve winding area on the spool and brought into the region of the thread guide of the traversing device at the outlet side of the worm.

Stretchable threads, that is, threads which are only partly prestretched when arriving at the winding stage, are now frequently wound. The final stretching of the threads is only effected during texturizing when the heat generated at this stage can also be utilized. When such partially stretched threads are applied to the spool, i.e. are inserted into a notch or groove in an end location of the spool, it is unavoidable that they will be stretched slightly further. The degree of this further stretching is uncontrollable at the beginning of the winding process. Greater or lesser jolts or shocks can be experienced by the thread to be wound. Thus, the thread undergoes different tensions thereby giving rise to different degrees of partial stretching of the thread. Such a thread is unsuitable for any practical use. It has been found that the varying partial stretching of the thread has an effect on further processing. For example, the physical condition of the thread has an effect on the dyeing process thereby causing adverse effects on the finished product. It is therefore desirable that the initial length of thread wound onto the spool and which is subjected to uncontrollable tensions, can be easily eliminated during the later use of the thread spool. It is desirable that a significant and usable portion of a reserve winding incorporate normal conditions of constant thread tension so that the thread may be usable for later processing.

PURPOSE OF THE INVENTION

The primary object of the invention is to provide an assembly for forming a waste winding on the spool before the production of a reserve winding which will consequently have a satisfactory or normalized tension condition on the thread.

SUMMARY OF THE INVENTION

The apparatus as disclosed herein includes a rotatably mounted worm having an inlet side and an outlet side. A predetermined number of relatively narrow circumferential grooves extend from the inlet side toward the outlet side. Thereafter, at least one relatively wide circumferential groove having a larger pitch than the narrow grooves extend to the runoff or outlet end of the worm body. A waste winding is formed on the spool while the thread is within the section of the rotary worm body having the smaller pitched circumferential grooves. The normal or standard reserve winding section is formed on the spool while the thread is tangentially engaging the circumferential groove having the larger pitch.

In other words, the rotatably mounted wirm has a plurality of grooves and is subdivided with respect to the pitch of certain circumferential grooves. The grooves having the small pitch extend a first limited axial distance along the circumference of the worm from an inlet side to an outlet side. The larger pitch grooves extend a second limited axial distance along the circumference of the worm. The specific and structural configuration of the worm first causes the formation of a waste winding along the winding area of the spool. The thread in this waste winding is wound for a short period of time in closely adjacent spirals onto the spool. Only thereafter does the normal or standard reserve winding begin. The waste winding and the reserve winding merge harmoniously one into the other. No further separate control units are required. The thread in the closely adjacent spirals of the waste winding have a very dense sequence. These few closely adjacent windings or spirals of the thread are sufficient to provide conditions of constant tensions so that the degree of partial stretching of the thread is no longer impaired.

The formation of the reserve winding is thus effected without an intermediate transition at a predetermined thread tension of the partially stretched thread. The waste winding may easily be removed without problem thereby leading to the release of the beginning of the reserve winding. The waste winding is simply cut transversely so that it drops from the spool. Thus, the beginning of the reserve winding is released. At this point, a thread of predetermined quality is presented in the reserve winding with a partial stretching or tension condition having been effected.

A further feature of the invention is directed to the ratio of the wide thread passage or groove with a large pitch to the narrow thread passages or grooves having a lesser pitch. This ratio can be varied according to the requirements and type of thread being wound. In general, this ratio is from about 1:3 to 1:5. A constant-r.p.m. electric motor may serve as a drive means for the rotatably mounted worm. An electric motor insures an extremely precisely controlled constant r.p.m. This contributes to reliable and uniform guidance of the thread during the formation of the waste winding and the reserve winding. The electric motor may be started through the use of a switch that is controlled by movement of the thread along the axial length of the spool. The switch may be located in front of the point of action of the mechanism for forming a loop in the thread for maintaining the thread tension during the initial start of the winding.

DESCRIPTION OF SPECIFIC EMBODIMENTS

Figure 1:
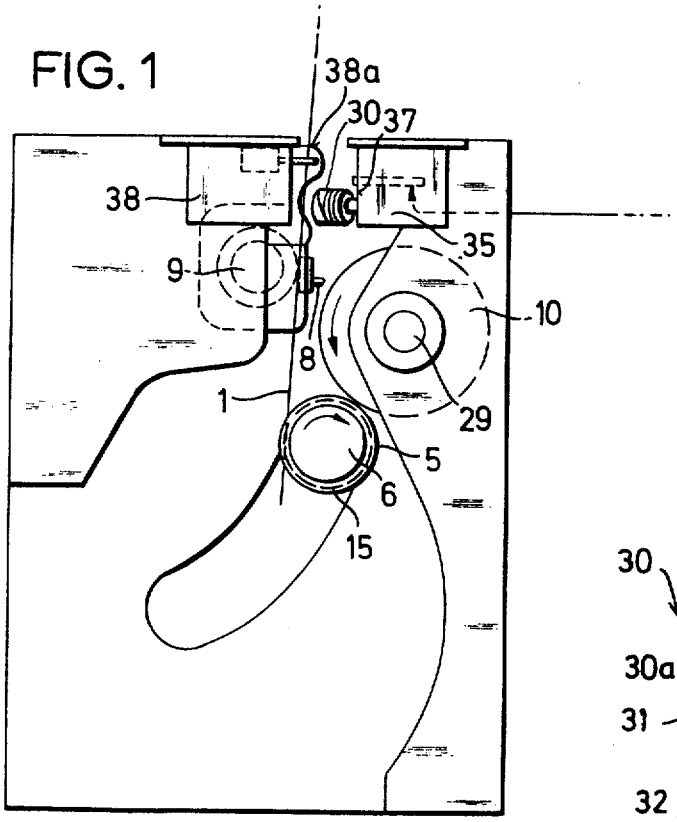
FIG. 1 is a diagrammatic front elevational view of an apparatus made in accordance with this invention.
Figure 3:
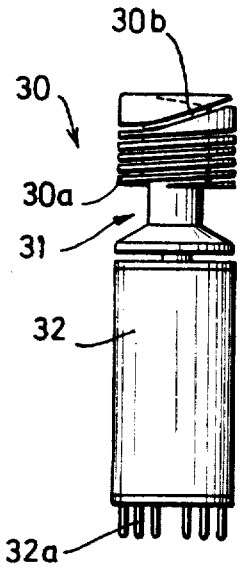
FIG. 3 is a front elevational view of the worm body with its drive device.
Figure 2:
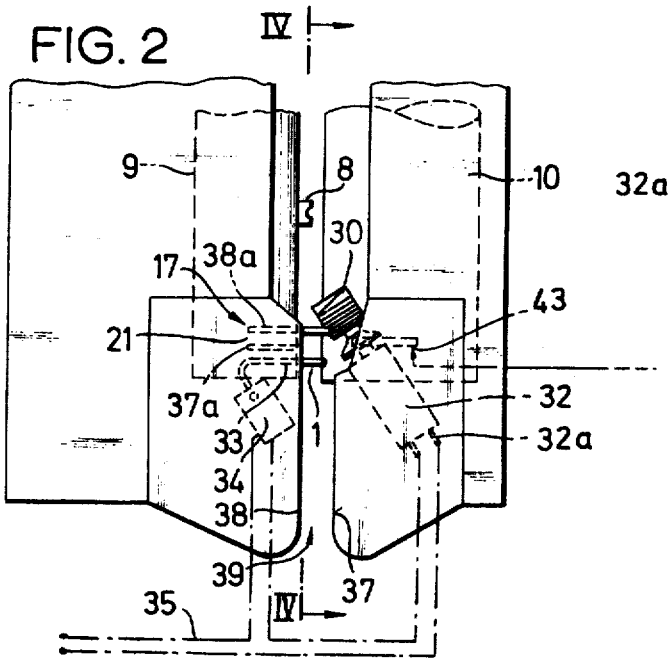
FIG. 2 is a plan view of the apparatus of FIG. 1 shown at the beginning of the insertion of the thread into the apparatus.
Figure 4:
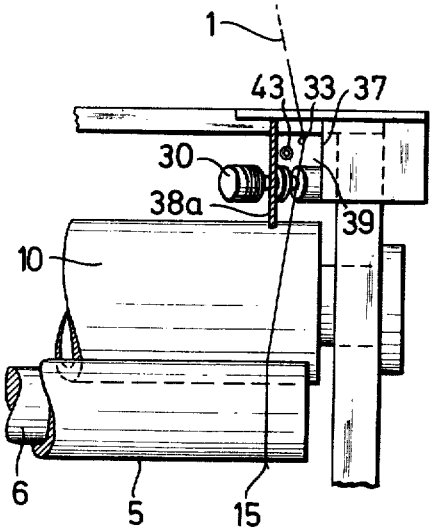
FIGS. 4 through 7 are sectional views taken along line IV—IV of FIG. 2 showing four different positions of the thread during the insertion procedure to winding of the thread onto the spool.
Figure 5:
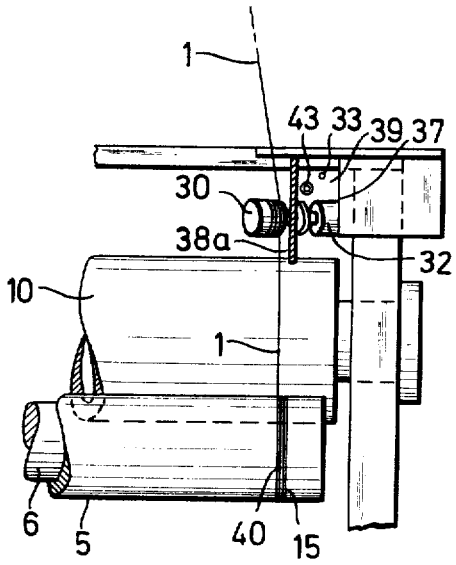

More specifically, referring to the drawings, thread 1 is fed to a spool 5 by a delivery mechanism operating at constant r.p.m. The delivery mechanism is mounted on a shaft 6 which is an expanding shaft in this specific embodiment. A traversing device includes a thread guide 8 which is driven by a reverse-thread roller 9 and guides thread 1 longitudinally to-and-fro continuously over spool 5. Friction roller 10 drives either the shaft 6 or spool 5. Friction roller 10 is mounted on shaft 29 and may be directly formed as a roller motor. A transverse notch 15 is located on spool 5 at a location outside the winding area in which the thread package is to be formed. The start or end of the thread 1 is first clamped in the notch 15 to initiate the winding. Friction roller 10 and spool 5 are driven in a rotary direction indicated by the arrows on those elements as shown in FIG. 1.

An auxiliary mechanism includes a blower device 43 as a feed duct for a blown fluid medium. The auxiliary mechanism prevents fluttering of the start of the thread after it has been inserted into notch 15 of spool 5. A casing head 17 is formed by fixed guide plates **37*a* and 38*a* and includes a continuously open chamber 21. The casing head 17 is located opposite the blower device 43. A thread loop formed by the blower device is displaced between the fixed guides 37*a* and 38*a*. A rotary worm 30 serves as a deflector and conveyor unit for the thread in forming a waste winding and the reserve winding on the spool. Thread 1 engages worm 30** tangentially.

The rotatably mounted worm 30 has an inlet side and includes threaded or grooved portions of different pitches. Several relatively narrow circumferential grooves **30*a* are located in a first limited area extending from the annular groove 31 toward the outlet side. The circumferential grooves 30*a* connect directly with a further groove 30*b* having a relatively larger pitch than grooves 30*a*. The narrow grooves or threads 30*a* serve to produce a waste winding. The wide groove or thread 30*b* having the larger pitch produces the reserve winding. Worm 30 is driven by a constant-r.p.m. electric motor 32. The electric motor 32 may reach a speed of about 2600 r.p.m. at which speed the device may be driven. Connections 32*a* are used for attaching electric power cables to the electric motor 32**.

A release unit for controlling electric motor 32 includes a feeler 33 that is operably associated with a switch 34. That is, feeler 33 is combined with or connected to a switch 34 in a well known manner. In this specific embodiment, feeler 33 is pivotally mounted with respect to switch 34. A control cable 35 leads from switch 34 to the connections **32*a* of electric motor 32. Motor 32 is connected in a conventional manner to a source of electric current. A slot 39 is formed between two guide plates 37 and 38. Thread 1 is inserted through slot 39 until it reaches feeler 33 which yields under the tension of the thread or is pivoted thereby. When the start of the thread is inserted into notch 15 on spool 5, a thread traction having a transversely acting component of force is established. When feeler 33 yields, thread 1 slips therefrom and passes in front of the blower duct which acts to form a thread loop within the chamber 21. Thread 1 is fed from a point located above spool 5 or the traversing device in the middle of the length of spool 5 forming what is known in the prior art as a thread triangle seen in the plane of the drawing of FIGS. 4 to 7. Consequently, as a result of this oblique direction on starting the thread at one end of the spool, thread 1 tends to move to the left slipping off the guide plate 38*a*** after the thread loop has been raised.

Figure 6:
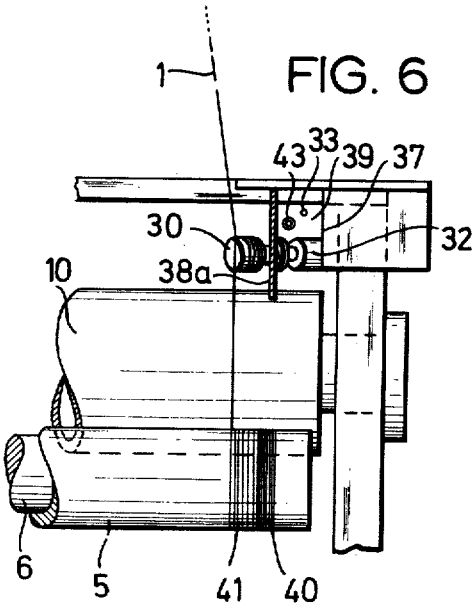
Figure 7:
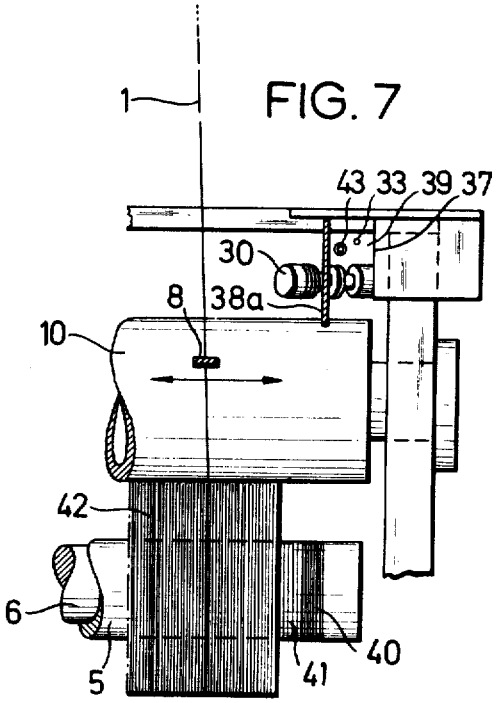

Thread 1 now passes directly into the wide groove 31 located on the body of the worm 30. When thread 1 moves into thread **30*a* having the smallest pitch, it is wound onto spool 5 in a very dense sequence having adjacent spirals thereby forming waste winding 40. After about six to nine thread windings have been formed on spool 5, as worm 30 rotates, thread 1 passes directly into the thread passage 30*b* having a considerably larger pitch than grooves 30*a*. The reserve winding 41 is built up on spool 5 as shown in FIG. 6 while in the thread passage or groove 30*b* of worm 30. Reserve winding 41 is formed until thread 1 has left the outlet side of worm 30 and has been taken up by the thread guide 8 of the traversing device 9. A thread roll 42 is consequently produced on spool 5** in a well known manner.

Before the reserve winding 41 is used for connection to an adjacent thread package during the unwinding process, waste winding 40 is released from spool 5 by a transverse cut. This releases the beginning of the reserve winding 41 so that the thread in winding 41 may be knotted to a neighboring spool winding. The irregularly stretched thread portion is located in waste winding 40. This portion is unusable and is thrown away. The thread tension has reverted to a normal value at the end of the waste winding 40. Consequently, the reserve winding 41 has a thread with the normal, predetermined degree of partial stretching desired.

ADVANTAGES OF THE INVENTION

The specific design of the rotatably mounted worm results in a very uniform procedure of winding the beginning of the thread onto the spool. The apparatus is simple in construction and results in a considerable saving in separate control units. The thread application for both the dead or waste winding and the reserve winding is carried out in an extremely clean manner. Consequently, safe and reliable operation can be carried out at very high thread speeds which may be up to about 4,000 meters per minute.

While the apparatus for forming a waste winding adjacent a reserve winding when winding a thread onto a spool has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. An apparatus for initially winding a thread onto a spool core having a thread package winding area, said apparatus comprising:

a. means for forming a waste winding at an end location of the spool core, b. means for forming a reserve winding at said end location adjacent said waste winding, and c. a traversing device for directing the thread from the reserve winding to the winding area along the spool core to form a thread package, d. said winding forming means including a rotatably mounted worm disposed between the end location and the traversing device and a drive means for rotating said worm, e. said worm being disposed for tangential contact with the thread and being effective to move the thread from an inlet side of the worm to an outlet side thereof, f. said worm including a predetermined number of circumferential grooves having a relatively small pitch extending from the inlet side toward the outlet side and immediately thereafter at least one further circumferential groove having a larger pitch, g. said small pitch circumferential grooves being effective to form said waste winding immediately preceding the formation of said reserve winding formed while the thread moves through the larger pitch circumferential groove until the thread runs off the outlet side of the worm body.

2. An apparatus as defined in claim 1 wherein said drive means includes a constant-r.p.m. electric motor that is effective to rotate the worm.

3. An apparatus as defined in claim 1 wherein the ratio of the larger pitch circumferential groove to the smaller pitch circumferential grooves is about 1:3 to 1:5.

4. An apparatus as defined in claim 1 wherein a slot is provided in the spool to receive the end of the thread to be wound on the spool, said winding forming means includes a feeler means disposed in the path of the thread to be wound and a switch means responsive to said feeler means, said switch means being effective to activate said drive means for the worm when said feeler means yields under the influence of said thread.

5. An apparatus for forming a waste winding adjacent a reserve winding when winding a thread onto a spool having a thread package winding area, said apparatus comprising:

a. means for delivering a supply of thread to a spool core at an end location axially displaced from said winding area, b. a traversing device for directing supply of thread from the reserve winding to the winding area along the spool core to form a thread package, c. a rotatably mounted worm disposed between the end location and the traversing device, and d. a drive means for rotating said worm, e. said worm being disposed for tangential contact with the thread being supplied from the delivery mechanism and being effective to move the thread from an inlet side of the worm to an outlet side thereof, f. said worm including a plurality of grooves having a relatively small pitch extending a first limited axial distance along the circumference of the worm and immediately thereafter at least one groove extending a second limited axial distance along the circumference of the worm, g. said first limited axial distance constituting a waste winding forming portion and said second limited axial distance constituting a reserve winding forming portion.

6. An apparatus as defined in claim 5 wherein the ratio of the larger pitch circumferential groove in said second limited axial distance to the smaller pitch circumferential grooves in said first limited axial distance is about 1:3 to 1.5.

* * * * *